United States Patent [19]

Heitz

[11] Patent Number: 5,072,515

[45] Date of Patent: Dec. 17, 1991

[54] DEVICE FOR SLITTING AND CURLING ORNAMENTAL PACKAGING RIBBONS

[76] Inventor: Walter-Helmut Heitz, Hoher Holzweg 22, D-3005 Hemmingen 4, Fed. Rep. of Germany

[21] Appl. No.: 458,138

[22] Filed: Dec. 28, 1989

[30] Foreign Application Priority Data

Dec. 31, 1988 [DE] Fed. Rep. of Germany ... 8816240[U]

[51] Int. Cl.[5] ..... B26B 3/04

[52] U.S. Cl. ..... 30/304; 30/294; 83/858

[58] Field of Search ..... 30/304, 279.2, DIG. 3, 30/345, 294, 363; 83/856, 858, 30

[56] References Cited

U.S. PATENT DOCUMENTS

| | | | |
|---|---|---|---|
| 2,547,249 | 4/1951 | Bell | 30/304 |
| 2,580,526 | 1/1952 | Dawson | 30/279.2 |
| 2,782,856 | 2/1957 | Staley | 30/363 |
| 3,355,803 | 12/1967 | Hanlon et al. . | |
| 3,883,953 | 5/1975 | Saullo et al. | 30/304 |
| 4,383,365 | 5/1983 | Metzigan | 30/114 |
| 4,563,814 | 1/1986 | Trichell et al. | 30/225 |
| 4,711,031 | 12/1987 | Annello | 30/294 |
| 4,879,932 | 11/1989 | Scalise et al. | 83/30 |

FOREIGN PATENT DOCUMENTS 3629168 2/1988 Fed. Rep. of Germany .

*Primary Examiner*—Frank T. Yost
*Assistant Examiner*—John M. Husar
*Attorney, Agent, or Firm*—Collard, Roe & Galgano

[57] ABSTRACT

A device for slitting and curling ornamental packaging ribbons is formed with a cutting punch which is elastically and movably connected with a counterplate. On the side of the cutting punch facing the counterplate, the cutting punch has a plurality of cutting elements embodied in the form of plastic blades extending in the direction of the relative motion between the device and the ornamental packaging ribbon. The counterplate is formed as a matrix with holes corresponding with the plastic blades into which the latter are inserted.

12 Claims, 2 Drawing Sheets

DEVICE FOR SLITTING AND CURLING ORNAMENTAL PACKAGING RIBBONS

The present invention relates to a device for slitting and curling ornamental packaging ribbon and, more particularly, the present invention relates to a hand held and operated device for slitting and curling ornamental packaging ribbon.

Fancy packaging ribbons are used for packaging gifts for the purpose of visual enhancement of the package. To further enhance the appearance of the package, such ribbons are often slit in the longitudinal direction, so that a greater number of narrow ribbons are produced. In addition, it is also customary to produce so-called curled ribbons by pulling the ornamental packaging ribbon across a sharp edge, and when the fancy packaging ribbon has been additionally slit in the lengthwise direction, the individual narrow ribbons resulting from such slitting will curl.

A device is disclosed in U.S. Pat. No. 3,883,953, to Saullo et al, granted May 20, 1975, which permits slitting of an ornamental packaging ribbon. This device consists of a cutting punch which is elastically and movably connected with a counterplate, whereby the cutting punch, on its side facing the counterplate, has a plurality of cutting elements for slitting the fancy packaging ribbon. In this known device, the cutting elements are formed of pointed, comb-like metal teeth. The manufacture of such metal teeth is very costly because they cannot be produced by punching, the reason being that when such teeth are punched, a burr forms particularly in the region of the points, so that post treatment filing is required in order to obtain sharp points. Such a final treatment, however, is labor intensive in the production of many units and hence expensive. In addition, in this device, the metal teeth extend transversely relative to the direction in which the ornamental packaging ribbon is moved for slitting between the cutting punch and the counterplate. Therefore, in the course of the slitting action, the fancy packaging ribbon moves upwardly into the enlarged cross section of the teeth resulting in the ornamental packaging ribbon being slit in an untidy and visually unattractive way, because when the fancy packaging ribbon moves upwardly, it is no longer slit by the points of the metal teeth but rather by their widened cross section, so that the fancy packaging ribbon is not slit cleanly, but rather it is torn apart. This known device has not been successful in practical use for these reasons.

The object of the present invention is to provide a device which, in combination with its simple and favorably priced manufacture and ease of handling, results in a safe and clean slitting of ornamental packaging ribbons.

The above object is accomplished in accordance with the present invention by providing a device for slitting and curling ornamental packaging ribbons wherein the cutting elements are embodied in the form of plastic blades which do not extend crosswise relative to the relative motion between the device and the ornamental packaging ribbon, but rather in the direction of said relative motion. In addition, the counterplate is embodied in the form of a matrix with a plurality of holes, where each hole is associated with each individual plastic blade, permitting the respective plastic blade to enter into the hole associated therewith. A cleanly slit ornamental packaging ribbon is obtained by use of the present invention. Since the individual plastic blades can enter into the holes, it is assured that the plastic blades penetrate or pierce the ornamental packaging ribbon and, since the plastic blades extend in the direction of relative motion between the device and the ornamental packaging ribbon, perfect slitting is possible after the fancy packaging ribbon has been penetrated or pierced by the plastic blades. Preferably, not only are the cutting blades formed of plastic but also the entire device is formed of plastic material.

In a preferred embodiment of the present invention, the plastic blades are shaped like a type of stiletto having a point, whereby both outer edges of each plastic blade are sharp. In this way, the device can be used both with the left and right hands because in either of the two possible directions of motion, the sharp outer edges will cause slitting of the ornamental packaging ribbon.

In another preferred embodiment of the present invention, the cutting punch and the counterplate are connected and supported at their centers so as to form a bifurcated device and they are movable parallel with each other. In their working or operating positions, the cutting punch and the counterplate are arranged parallel to one another so that one is disposed above the other, so that the plastic blades penetrate into their respective holes simultaneously, the holes being advantageously designed as slots. This measure permits safe guidance because the cutting punch and the counterplate, in their operating positions, are disposed one above the other without clearance.

According to yet another embodiment of the present invention, provision is made for the cutting punch and/or the counterplate to have a sharp undercut edge on at least one of the longitudinal sides thereof. This edge makes it possible for the fancy packaging ribbon to not only be slit but at the same time also curled by pulling the fancy packaging ribbon across the sharp edge.

Alternatively to providing a plurality of holes in the counterplate to accept the corresponding plastic blades, it is also possible to provide the surface of the counterplate facing the cutting punch in the form of a soft surface. Experience has demonstrated that it is sufficient to embody the surface of the counterplate as a soft surface for producing a visually clean-cut curled ribbon with the novel type of plastic blades. By using such a soft surface, the points of the plastic blades pierce the fancy packaging ribbon as the cutting punch and the counterplate are pressed together, permitting the ornamental packaging ribbon to be slit cleanly.

Other objects and features of the present invention will become apparent from the following detailed description considered in connection with the accompanying drawings. It is to be understood, however, that the drawings are designed for the purpose of illustration only and not as a definition of the limits of the invention.

In the drawings, wherein similar reference characters denote similar elements throughout the several views.

Figure 1:
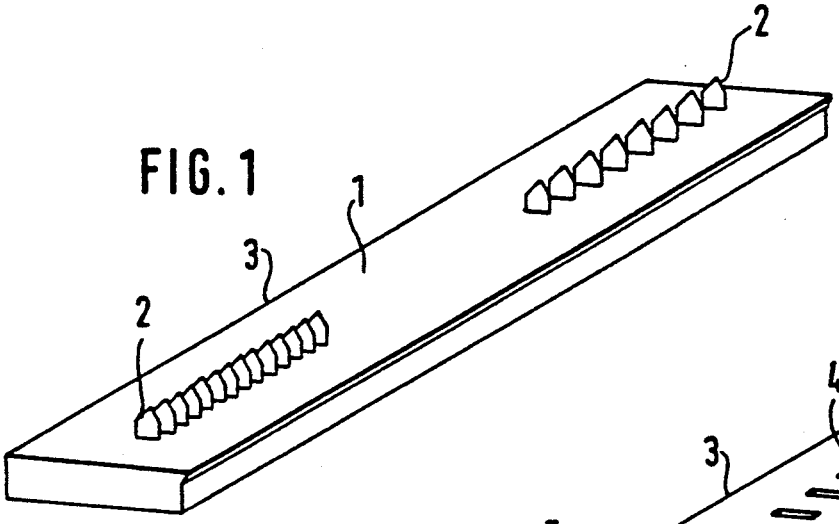
FIG. 1 is a schematic perspective view of the cutting punch portion of the device according to the present invention.
Figure 2:
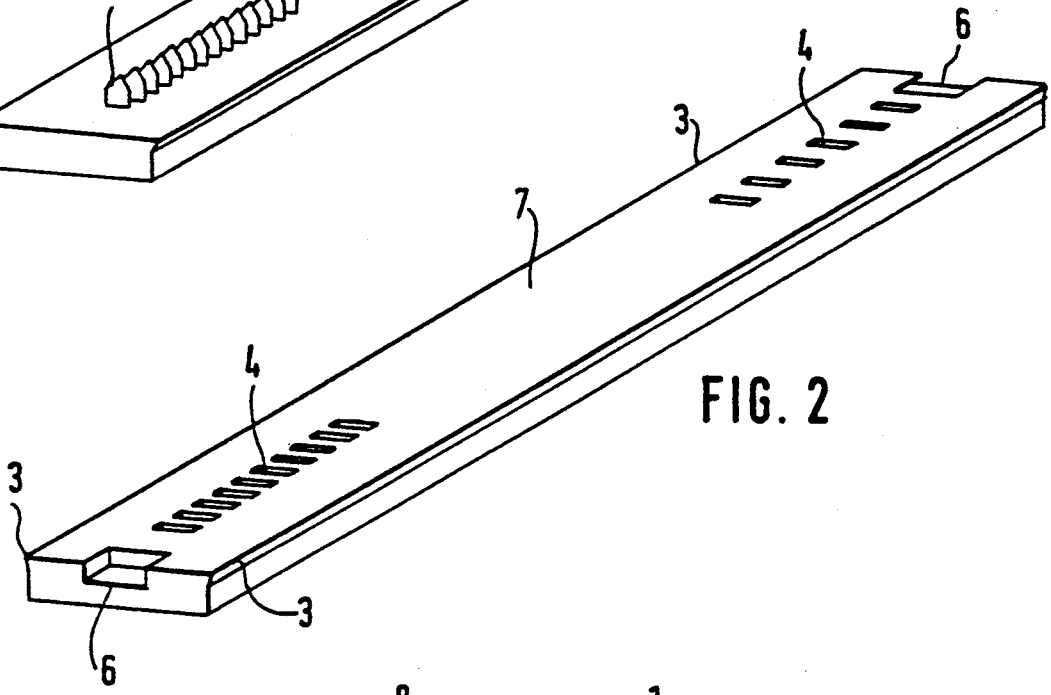
FIG. 2 is a schematic perspective view of the counterplate portion of the device according to the present invention.
Figure 3:
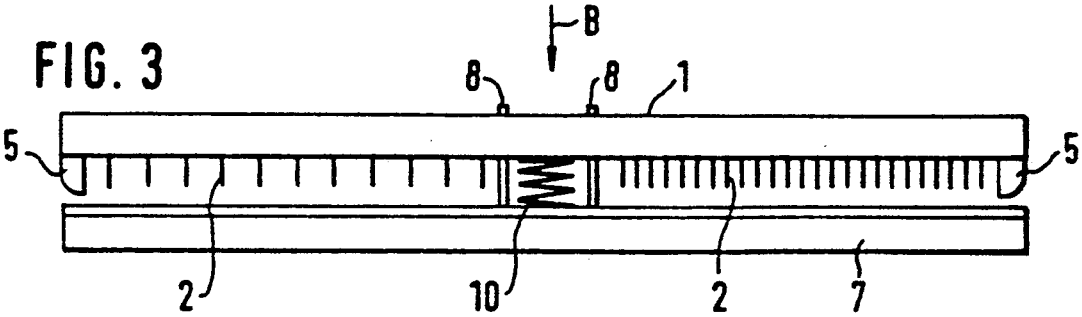
FIG. 3 is a side elevational view of a bifurcated device according to the present invention.

Now, turning to the drawings, there is shown in FIGS. 1 and 2, a cutting punch 1 and a counterplate 7 which, in their assembled condition, form a device for slitting and curling fancy packaging ribbons. FIG. 3 shows cutting punch 1 and counterpressure plate 7 in the assembled condition, forming the device.

Figure 5:
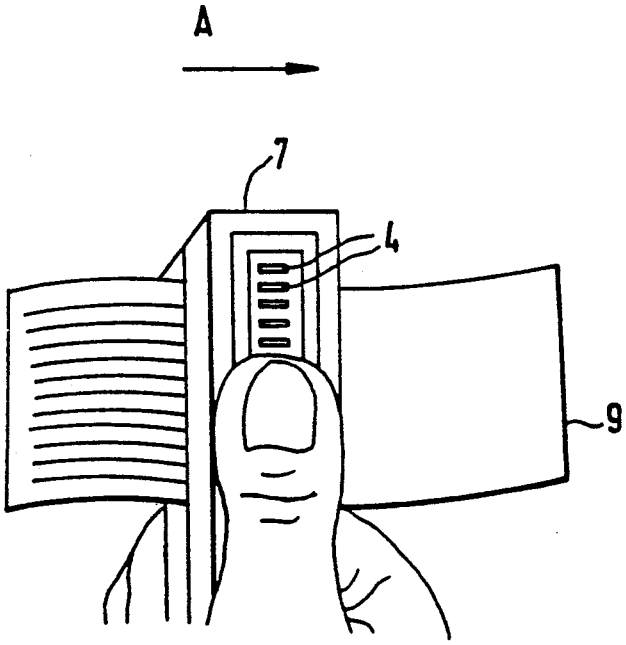
FIG. 5 is a perspective view demonstrating how the device according to the present invention is operated.

At the side facing counterplate 7, cutting punch 1 has two rows of plastic blades 2, each arranged with different spacings relative to one another, so that it is possible to obtain different slitting widths of ornamental packing ribbons. Plastic blades 2 have a shape similar to that of a stiletto with a point and extend in the direction of relative motion A between the device and ornamental packaging ribbon 9 (cf. FIG. 5). The two outer edges of each plastic blade 2 are sharp, so that the direction of relative motion A between the device and the ornamental packaging ribbon is irrelevant since both right- and left-hand operation of the device is possible.

Figure 4:
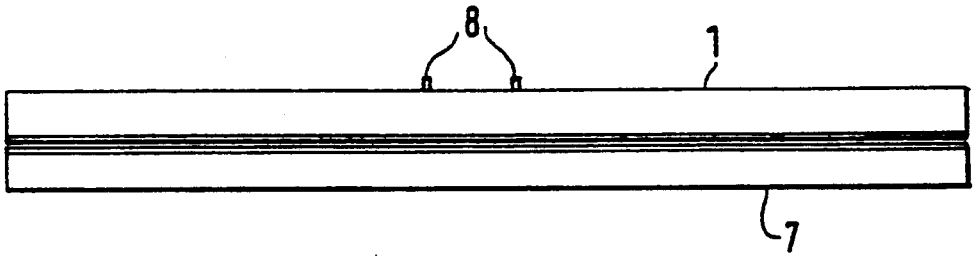
FIG. 4 is a side elevational view of the bifurcated device of FIG. 3 showing the cutting punch and the counterplate pressed together.

As clearly seen in FIG. 2, counterplate 7 is embodied in the form of a matrix having holes in the form of slots 4. A slot 4 is associated with each plastic blade 2 of cutting punch 1. Hence, each plastic blade 2 can enter into or engage its associated slot 4 when cutting punch 1 and counterplate 7 are pressed together as shown in FIG. 4. It is also possible to provide the surface of counterplate 7 facing blades 2 with a soft material to engage blades 2 rather than holes or slots 4.

As clearly seen in FIG. 3, cutting punch 1 and counterplate 7 are connected with one another and guided via guide pins 8 in such a way that they are movable parallel with each other in the direction of arrow B. Such motion takes place against the biasing action of a spring 10, so that when cutting punch 1 and counterplate 7 are released, the resting position shown in FIG. 3 is assumed. In such resting position, a fancy packaging ribbon can be inserted between the cutting punch 1 and the counterplate 7. Cutting punch 1 and counterplate 7 are then pressed together against the force of spring 10, while guide nose 5 engages with groove 6 to maintain alignment, so that the operating position according to FIG. 4 is assumed. Plastic blades 2 pierce the ornamental packaging ribbon as such compression is effected, whereby plastic blades 2 enter into slots 4. The device is subsequently moved in the direction of arrow A in FIG. 5 as the ornamental packaging ribbon 9 is, for example, held by hand, and the latter is slit as the device moves. The packaging ribbon is simultaneously curled by drawing it across one of the sharp undercut edges 3 on cutting punch 1 or counterplate 7.

In the compressed condition according to FIG. 4, outer guide noses 5 of cutting punch 1, which noses can be seen in FIG. 3, engage in matching guide grooves 6 of counterplate 7, so that cutting punch 1 and counterplate 7 assume a stable position and are supported safely locked against rotational displacement.

Figure 6:
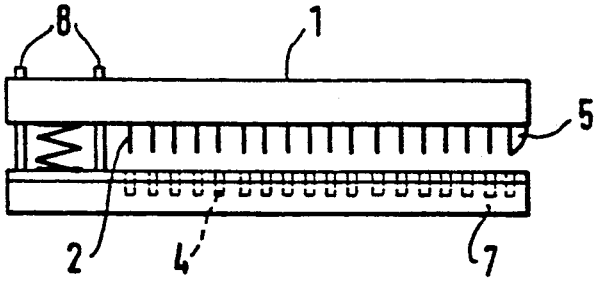
FIG. 6 is a perspective view of another embodiment of the device of the present invention.

While FIGS. 1 to 4 show an embodiment of the device of the type which is bifurcated with center fastening and support, FIG. 6 shows a device having different embodiment forming a simple forked unit. The mode of operation and principle of this embodiment are the same as described above. However, with the device according to FIG. 6, only a single width of slit ribbons of ornamental packaging ribbon 9 can be obtained, whereas in the bifurcated embodiment according to FIG. 3, selection between two different widths is available, depending on whether the fancy packaging ribbon is inserted via the guide pins 8 to the left or to the right of the center support.

While only two embodiments of the present invention have been shown and described, it will be obvious that many changes and modifications may be made thereunto without departing from the spirit and scope of the invention.

What is claimed is:

1. A hand-held and operated device for slitting and curling ornamental packaging ribbon by pulling the ribbon through the device in a relative direction therebetween, said device comprising:

(a) a cutting punch having a plurality of cutting elements formed as fixed plastic blades each having a pair of oppositely-facing outer edges extending in the direction of said relative motion;

(b) a counterplate having a matrix with a plurality of holes each of which is associated with a corresponding plastic blade of said cutting punch, each plastic blade being insertable into the corresponding hole;

(c) means for elastically and movably connecting said cutting punch to said counterplate so that the side of said cutting punch having said plastic blades faces the side of said counterplate having said corresponding holes and so that said cutting punch and said counterplate are movable between an open position, in which the packaging ribbon may be inserted between said cutting punch and said counterplate, and a closed position in which said blades may pierce the packaging ribbon and penetrate the respective holes associated therewith, thereby permitting slitting of the packaging ribbon upon relative movement between said device and the ribbon;

(d) said cutting punch having a first end, a second end, and a center located between said first and second ends, and said counterplate having a first end, a second end, and a center located between said first and second ends;

(e) said means for connecting said cutting punch and said counterplate with each other and for supporting them in their centers so as to form a bifurcated device and enabling them to be movable parallel with each other and, in their operating positions, to be disposed one above the other, so that all said plastic blades penetrate into said corresponding holes simultaneously; and (f) wherein said means for connecting said cutting punch and said counterplate comprises a first guide pin separated from a second guide pin by a space therebetween, and a spring located in said space between said first guide pin and said second guide pin.

2. The device as defined in claim 1, wherein said outer edges of said plastic blades are sharp and merge into a point.

3. The device as defined in claim 2, wherein said holes are formed as slots.

4. The device as defined in claim 1, wherein said cutting punch and said counterplate have a sharp undercut edge on at least one of their longitudinal sides.

5. The device as defined in claim 1, wherein said device is formed of plastic material.

6. The device as defined in claim 1, wherein said cutting punch is provided with at least one guide nose at said first end; and said counterplate is provided with at least one guide groove at said first end for receiving said at least one guide nose at said first end.

7. A hand-held and operated device for slitting and curling ornamental packaging ribbon by pulling the ribbon through the device in a relative direction therebetween, said device comprising:

(a) a cutting punch having a plurality of cutting elements formed as fixed plastic blades each having a pair of opposite facing outer edges extending in the direction of said relative motion;

(b) a counterplate having a surface formed of soft material;

(c) means for elastically and movably connecting said cutting punch to said counterplate so that the side of said cutting punch having said plastic blades faces the side of said counterplate formed of the soft material, and so that said cutting punch and said counterplate are movable between an open position, in which the packaging ribbon may be inserted between said cutting punch and said counterplate, and a closed position in which said blades may pierce said ribbon and contact said counterplate of soft material, thereby permitting the packaging ribbon to be slit cleanly upon relative movement of said device and the ribbon;

(d) said cutting punch having a first end and a second end, and said counterplate having a first end and a second end;

(e) said means for connecting said cutting punch and said counterplate with each other and for supporting them in their first end enabling them to be movable parallel with each other and, in their operating positions, to be disposed one above the other, so that all said plastic blades contact said counterplate of soft material simultaneously; and (f) wherein said means for connecting said cutting punch and said counterplate comprises a first guide pin separated from a second guide pin by a space therebetween, and a spring located in said space between said first guide pin and said second guide pin.

8. The device as defined in claim 7, wherein said cutting punch is provided with at least one guide nose at the second end, and said counterplate is provided with at least one guide at the second end for receiving said at least one guide nose at the second end.

9. A hand-held and operated device for slitting and curling ornamental packaging ribbon by pulling the ribbon through the device in a relative direction therebetween, said device comprising:

(a) a cutting punch having a plurality of cutting elements formed as fixed plastic blades each having a pair of oppositely-facing outer edges extending in the direction of said relative motion;

(b) a counterplate having a matrix with a plurality of holes each of which is associated with a corresponding plastic blade of said cutting punch, each plastic blade being insertable into the corresponding hole;

(c) means for elastically and movably connecting said cutting punch to said counterplate so that the side of said cutting punch having said plastic blades faces the side of said counterplate having said corresponding holes and so that said cutting punch and said counterplate are movable between an open position, in which the packaging ribbon may be inserted between said cutting punch and said counterplate, and a closed position in which said blades may pierce the packaging ribbon and penetrate the respective holes associated therewith, thereby permitting slitting of the packaging ribbon upon relative movement between said device and the ribbon;

(d) said cutting punch having a first end, a second end, and said counterplate having a first end and a second end;

(e) said means for connecting said cutting punch and said counterplate with each other and for supporting them in their first end enabling them to be movable parallel with each other and, in their operating positions, to be disposed one above the other, so that all said plastic blades penetrate into said corresponding holes simultaneously; and (f) wherein said means for connecting said cutting punch and said counterplate comprises a first guide pin separated from a second guide pin by a space therebetween, and a spring located in said space between said first guide pin and said second guide pin.

10. The device as defined in claim 9, wherein said cutting punch is provided with at least one guide nose at said second end; and said counterplate is provided with at least one guide groove at the second end for receiving said at least one guide nose at the second end.

11. A hand-held and operated device for slitting and curling ornamental packaging ribbon by pulling the ribbon through the device in a relative direction therebetween, said device comprising:

(a) a cutting punch having a plurality of cutting elements formed as fixed plastic blades each having a pair of opposite facing outer edges extending in the direction of said relative motion;

(b) a counterplate having a surface formed of soft material;

(c) means for elastically and movably connecting said cutting punch to said counterplate so that the side of said cutting punch having said plastic blades faces the side of said counterplate formed of soft material, and so that said cutting punch and said counterplate are movable between an open position, in which the packaging ribbon may be inserted between said cutting punch and said counterplate, and a closed position in which said blades may pierce said ribbon and contact said counterplate of soft material, thereby permitting the packaging ribbon to be slit cleanly upon relative movement of said device and the ribbon;

(d) said cutting punch having a first end, a second end, and a center located between said first and second ends, and said counterplate having a first end, a second end, and a center located between said first and second ends;

(e) said means for connecting said cutting punch and said counterplate with each other and for supporting them in their centers so as to form a bifurcated device and enabling them to be movable parallel with each other and, in their operating positions, to be disposed one above the other, so that all said plastic blades contact said counterplate of soft material simultaneously; and (f) wherein said means for connecting said cutting punch and said counterplate comprises a first guide pin separated from a second guide pin by a space therebetween, and a spring located in said space between said first guide pin and said second guide pin.

12. The device as defined in claim 11, wherein said cutting punch is provided with at least one guide nose at said first end; and said counterplate is provided with at least one guide groove at said first end for receiving said at least one guide nose at said first end.

* * * * *